US006422884B1

(12) United States Patent
Babasick et al.

(10) Patent No.: US 6,422,884 B1
(45) Date of Patent: Jul. 23, 2002

(54) PRE-WIRED CIRCUIT COMPONENT FOR FLEXIBLE WIRING SYSTEM

(75) Inventors: Michael W. Babasick, Glendora; Kenneth E. Golyshko, Upland, both of CA (US); Lawrence L. Johnson, Otis Orchards, WA (US)

(73) Assignee: Sentinel Lighting Wiring Systems, Inc., Los Angeles, CA (US)

( * ) Notice: Subject to any disclaimer, the term of this patent is extended or adjusted under 35 U.S.C. 154(b) by 0 days.

(21) Appl. No.: 09/783,646

(22) Filed: Feb. 14, 2001

Related U.S. Application Data

(60) Provisional application No. 60/214,310, filed on Jun. 27, 2000.

(51) Int. Cl.[7] ..... H01R 27/00

(52) U.S. Cl. ..... 439/222; 439/357; 439/470; 439/956

(58) Field of Search ..... 439/222, 470, 439/956, 221, 218, 357, 358, 353

(56) References Cited

U.S. PATENT DOCUMENTS 3,300,163 A * 1/1967 Randolph ..... 248/56
3,354,742 A * 11/1967 Tschanz et al. ..... 74/502.4
4,109,989 A * 8/1978 Snyder, Jr. et al. ..... 439/140
4,134,045 A * 1/1979 Quin ..... 315/324
4,399,371 A 8/1983 Ziff et al.
5,276,280 A * 1/1994 Ball ..... 174/65 R
5,679,016 A 10/1997 Marder et al.
5,819,405 A * 10/1998 Marder et al. ..... 29/857

* cited by examiner

*Primary Examiner*—Brian Sircus
*Assistant Examiner*—Brian S. Webb
(74) *Attorney, Agent, or Firm*—McCormick, Paulding & Huber LLP

(57) ABSTRACT

A pre-wired electrical component for a flexible wiring system has a housing, a flexible power supply cable connected in strain relieving relation to the housing within an inlet opening in the housing, at least one power supply outlet member mounted in an associated power outlet opening in the housing and a rotational circuit selector which includes a first connecting member mounted in fixed position on and exposed externally of the housing. Electrical buses disposed within the housing and separated from each other by a dielectric bus separator electrically connecting the power supply cable to the power supply outlet member and to the first connecting element. A cord drop assembly comprises a part of the pre-wired component and includes a cord drop for connection to a lightening fixture and a second connecting member for releasable plugging connection with the first connecting element in a selected one of a plurality of angular positions of connection to provide power to the cord drop, each position providing a different output voltage for operating a lighting fixture. A strain relief device carried by the second connecting element forms a closure for an open end of the connector, provides strain relief for the cord drop relative to the first connecting element and cooperate with latches on the housing to releasably secure the cord drop assembly in a selected position of electrical connection to the first connecting element. Another pre-wired component may be pluggingly connected to the power supply outlet to extend the flexible wiring system to accommodate another lighting fixture.

30 Claims, 11 Drawing Sheets

PRE-WIRED CIRCUIT COMPONENT FOR FLEXIBLE WIRING SYSTEM

CROSS REFERENCE TO RELATED APPLICATIONS

This application claims priority to a prior U.S. provisional patent application entitled Pre-Wired Circuit Component for Flexible Wiring System filed on Jun. 27, 2000 by the applicant herein, and identified under Ser. No. 60/214,310.

FIELD OF INVENTION

This invention relates in general to modular electrical wiring systems for commercial and industrial applications and deals more specifically with an improved pre-wired circuit component for a modular flexible wiring system particularly suitable for lighting applications.

BACKGROUND OF INVENTION

Modular flexible wiring systems for the distribution of power to lighting fixtures used in office buildings, factories and the like, are known in the art and examples of such systems are found in U.S. Pat. No. 4,399,371 to Ziff et al. for Modular Wiring Systems, issued Aug. 16, 1983, and assigned to the assignee of the present invention. The pre-wired circuit component of the present invention is adapted for use in a flexible wiring system designed particularly to facilitate the installation of High Intensity Discharge (HID) commercial and industrial lightening fixtures with light sources such as mercury vapor, multi-vapor and high pressure sodium lamps which operate at differing voltages.

The general aim of the present invention is to provide an improved pre-wired circuit module to enable the provision of a system which utilizes a minimum number of components, satisfies a wide variety of applications, and gives the installer of HID commercial and industrial lightening fixtures a wide range of choices in the selection of fixtures for lighting applications. A further aim of the invention is to provide an improved pre-wired circuit component which includes a rotational circuit selector and an easy to read or feel circuit identifier which allows a qualified installer to select a phasing position at a fixture location during fixture installation. Yet another aim of the invention is to provide an improved pre-wired circuit component which includes integrated cable/cord clamping with internal strain relief.

Further objects and advantages of the invention will be apparent from the illustrations and description which follows.

SUMMARY OF THE INVENTION

In accordance with the present invention, a pre-wired circuit component for use in a flexible wiring system includes a housing defining a chamber containing a plurality of power conductors. An elongated flexible power supply cable for connection to a power supply source has at least three supply conductors and extends into the housing. Each of the supply conductors is connected to a respectively associated one of the power conductors within the housing. A rotational circuit selector assembly, which includes a generally cylindrical first connecting element, is mounted in fixed position in a power outlet opening in the housing and carries a first group of electrical contacts electrically connected to the power conductors within the housing. The rotational circuit selector further includes a generally cylindrical second connecting element for mating connection with the first connecting element. The second connecting element has a second group of electrical contacts which mate with contacts of the first group when the second connecting element is connected to the first connecting element. An elongated flexible cord drop attached to the second connecting element has a plurality of power outlet conductors, each electrically connected to a respectively associated one of the contacts of the second group. The cylindrical second connecting element is connectable in coaxial alignment to the first connecting element in a selected one of a plurality of possible connected positions angularly spaced from each other about the axis of the cylindrical first connecting element to establish electrical connection between electrical conductors in the supply cable and the cord drop. A pair of electrical outlet conductors of the cord drop are electrically connected to a different pair of electrical supply conductors of the supply cable in each one of the connected positions, whereby electrical power may be delivered by the supply cable to the cord drop at a substantially different voltage at each one of the possible connected positions.

DETAILED DESCRIPTION OF PREFERRED EMBODIMENTS

Figure 1:
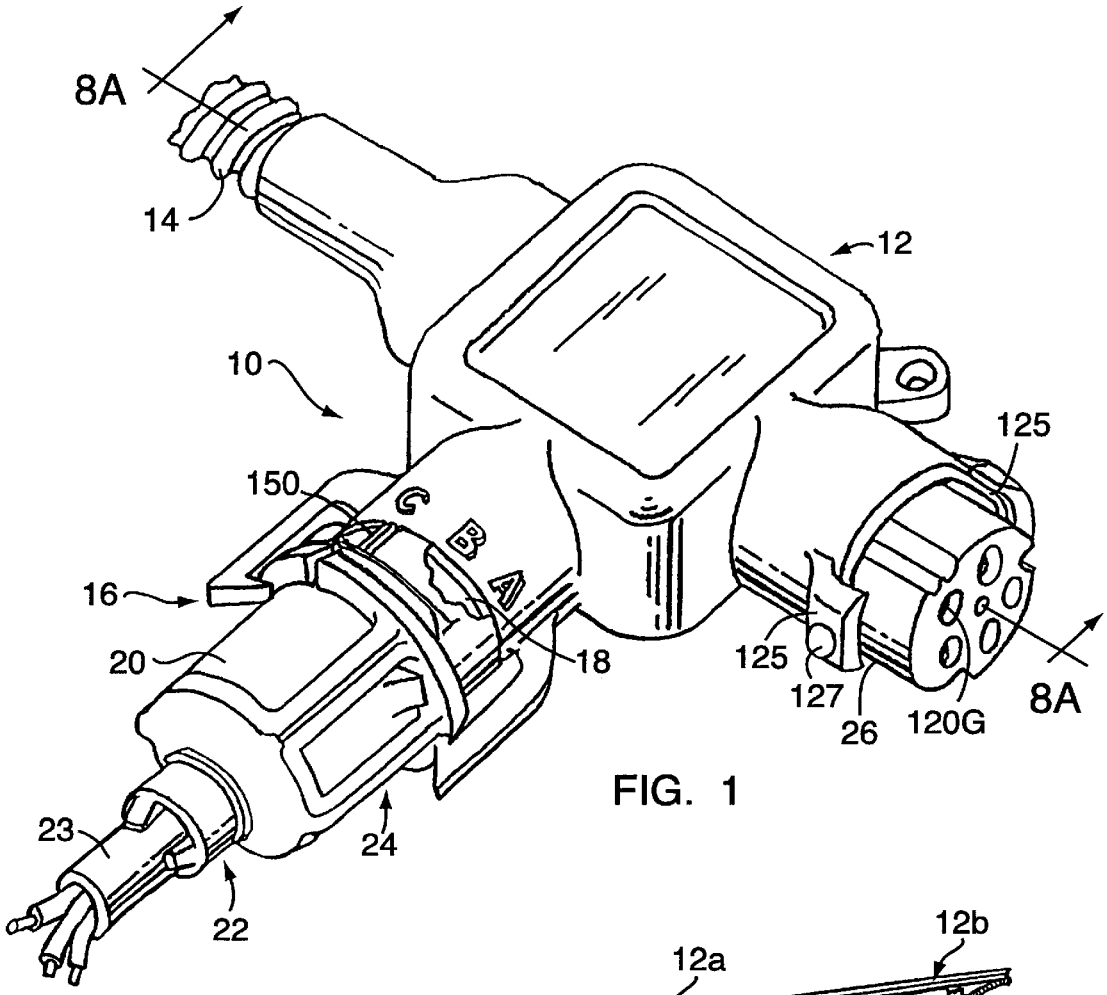
FIG. 1 is a perspective view of a pre-wired circuit component for a modular flexible wiring system and embodying the present invention.

In the drawings and in the description which follows, the present invention is illustrated and described with reference to a pre-wired electrical circuit component for a modular flexible wiring system of a type particularly suitable for use in a commercial or industrial lighting installation. The illustrated circuit component, shown in FIG. 1 and indicated generally by the reference numeral 10, is particularly adapted to facilitate installation of high intensity discharge (HID) commercial or industrial lighting fixtures having light sources, such as mercury vapor, multi-vapor and high pressure sodium lamps, which operate at differing voltages. Specifically, the pre-wired electrical circuit component 10, which embodies the present invention, is constructed and arranged to be readily connected in and form a part of a modular flexible wiring system for supplying power at a selected output voltage required to operate a particular type of electrical lighting fixture by means of a manually positioned rotational circuit selector which comprises a flexible cord drop assembly and which forms a part of the circuit component.

Figure 2:
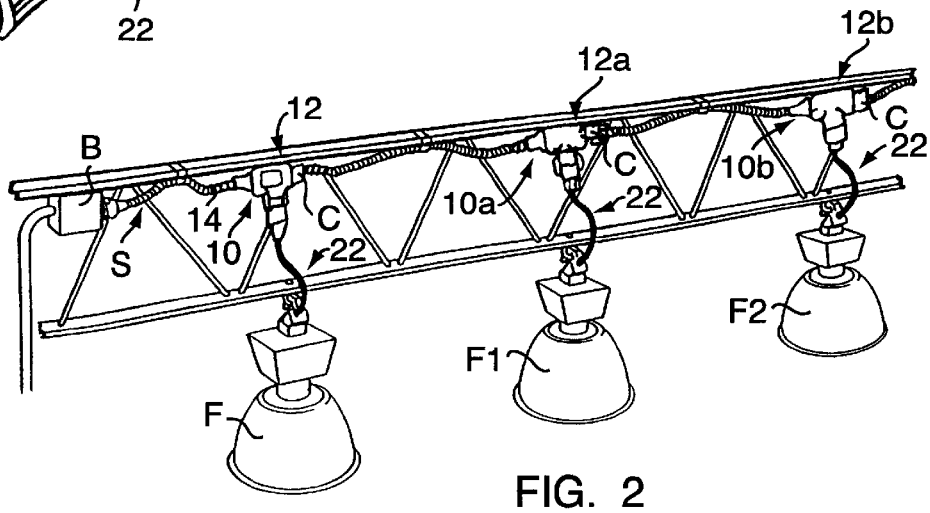
FIG. 2 is a somewhat reduced fragmentary perspective view of a power inlet end portion of a modular flexible lighting system having a plurality of connected pre-wired circuit components embodying the present invention.

A portion of a typical flexible industrial wiring system of a type in which the present invention is employed is indicated generally by the letter S in FIG. 2, wherein the starting point or power inlet end of the flexible wiring system S is shown. At the starting point, the flexible wiring system is connected by a pre-wired electrical component 10 to a junction box B located at a terminal end of a hard wired electrical system which receives AC power from a power supply source such as an electrical distribution panel (not shown). The illustrated flexible wiring system S, which comprises a plurality of pre-wired circuit components embodying the present invention and connected together as shown, includes components 10, 10*a* and 10*b*. Each of the individual circuit components 10, 10*a* and 10*b* supplies power to a respectively associated one of the illustrated lighting fixtures F, $F_1$ and $F_2$ by means of a flexible cord drop assembly, indicated generally at 22, substantially as shown in FIG. 2.

Figure 9:
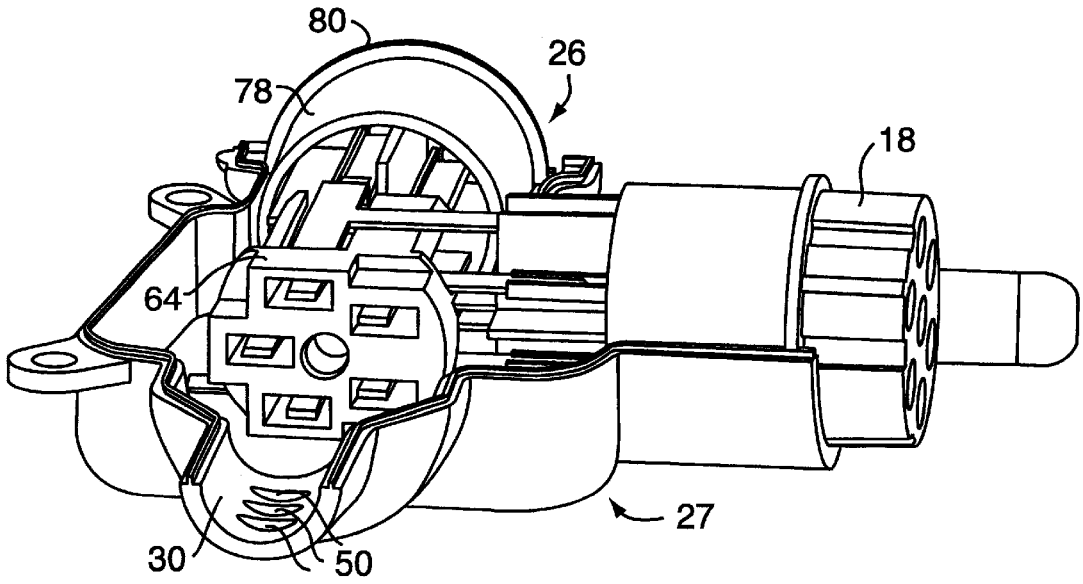
FIG. 9 is a perspective view similar to FIG. 7 but as viewed looking toward the housing power supply inlet opening.
Figure 7:
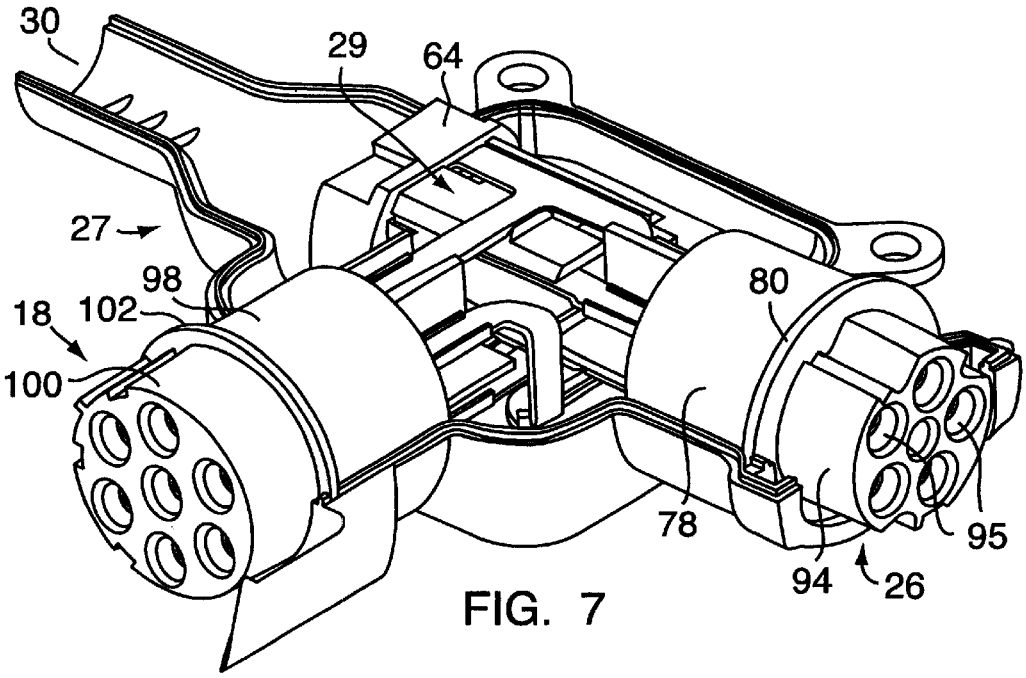
FIG. 7 is a perspective view showing the first connecting element, the power supply outlet member and the bus bar assembly in assembled position within the housing base.

The illustrated pre-wired electrical circuit component 10 embodying the present invention essentially comprises a housing or box, indicated generally at 12, a flexible power supply cable 14, attached in fixed position to the housing 12 for connection by suitable means to an electrical power supply source (not shown). Power received from the supply source energizes a rotational circuit selector assembly, indicated generally at 16 in FIG. 1, which includes a first connecting element 18, mounted in fixed position on and exposed externally of the housing 12, as best shown in FIGS. 7 and 9. The rotational circuit selector assembly 16 also includes a second connecting element 20 for releasable mating connection to the first connecting element 18 and which comprises a part of the cord drop assembly 22. A cord drop 23, which also comprises a part of the cord drop assembly 22, is connected to the second connecting element 20 and supplies power to an associated lighting fixture, such as the fixture F shown in FIG. 2.

In accordance with the present invention, the first and second connecting elements 18 and 20, which comprise the rotational circuit selector 16, are adapted for releasable mating connection in a selected one of a plurality of possible connected positions to facilitate appropriate phase, neutral and ground connection to the cord drop 23, whereby power is supplied at a proper voltage output to operate an associated lighting fixture, such as the fixture F of FIG. 2. The circuit selector assembly 16 enables a lighting fixture F to be readily removed from the system and replaced by a fixture of the same kind, which operates at the same voltage. The circuit selector assembly also enables all of the lighting fixtures which comprise a system to be replaced by fixtures of another kind, which operates at a substantially different voltage, by adjusting the circuit selectors in the system to supply the proper output voltage to the new fixtures.

The circuit component 10 further includes an improved strain relieving device indicated generally at 24 for releasably securing the first and second connecting elements 18 and 20 in connected mating engagement with each other in a selected one of a plurality of possible connected positions while relieving strain in the cord drop 23 relative to the housing 12. The component 10 also has an improved means for relieving strain on the power supply cable 14 relative to the housing, all of which will be hereinafter further evident from the illustrations in the drawings and the descriptive material which follows.

Preferably, and as best shown in FIG. 1, the circuit component 10 also includes at least one power supply outlet member 26 mounted in fixed position on the housing 12 to receive power from a power supply source to which the power supply cable 14 is connected. The outlet member 26 supplies power to a mating connector (not shown), as, for example, a mating plugging connector on a power supply cable of another electrical circuit component of like kind, such as the illustrated circuit component 10*a* shown in FIG. 2, whereby the lighting circuit S is extended to operate another lighting fixture, such as the fixture $F_1$ of FIG. 2.

Figure 3:
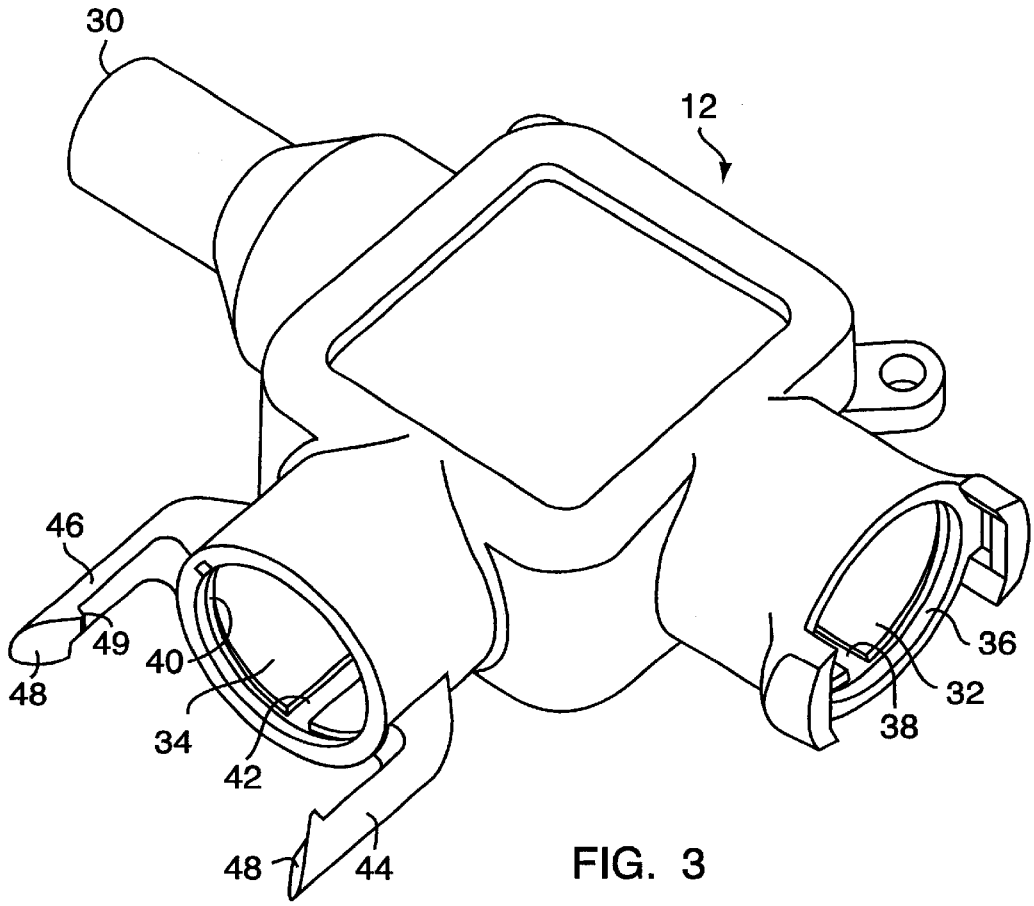
FIG. 3 is a perspective view of the housing of the circuit component shown in FIG. 1.
Figure 4:
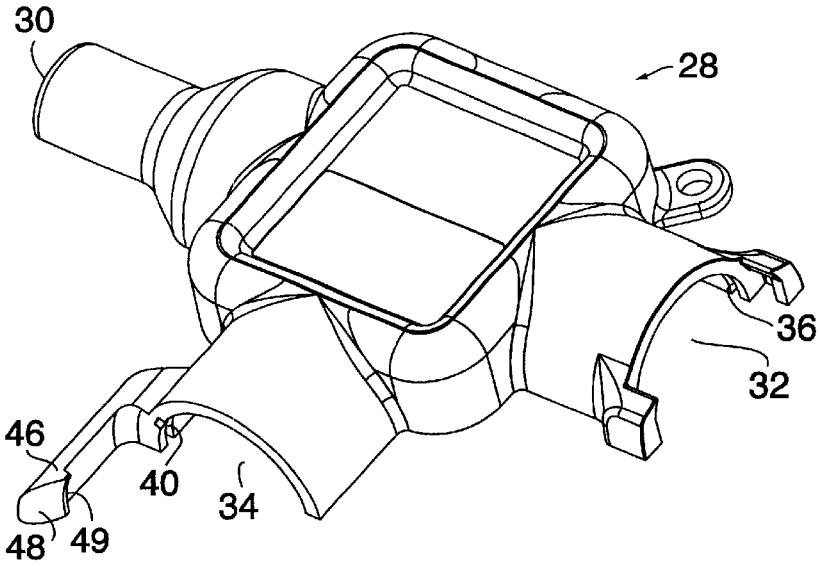
FIG. 4 is a perspective view of the housing cover.
Figure 5:
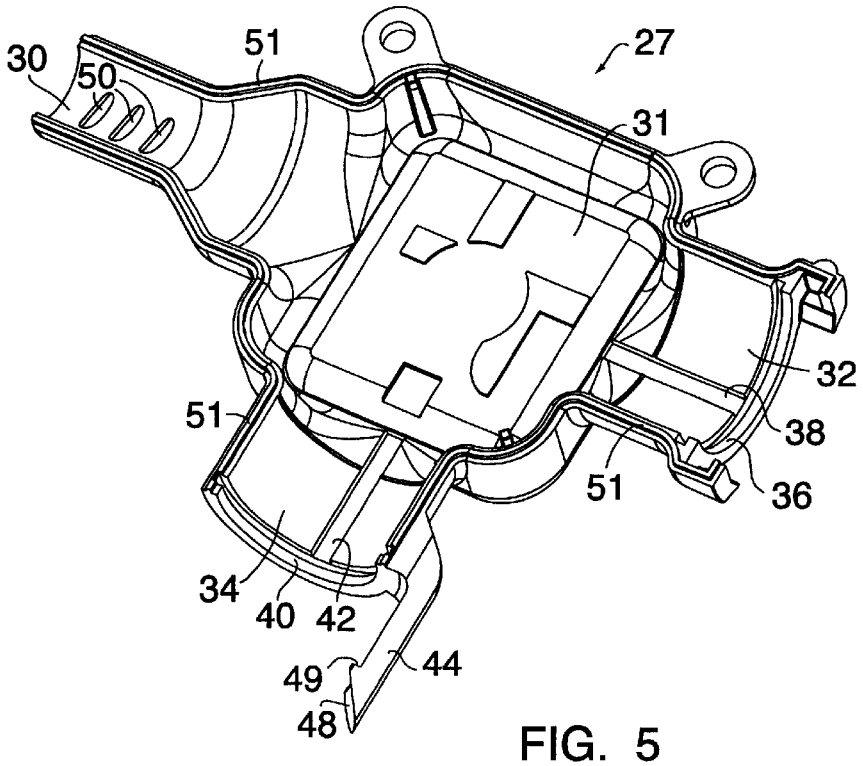
FIG. 5 is a perspective view showing the interior of the housing base.
Figure 6:
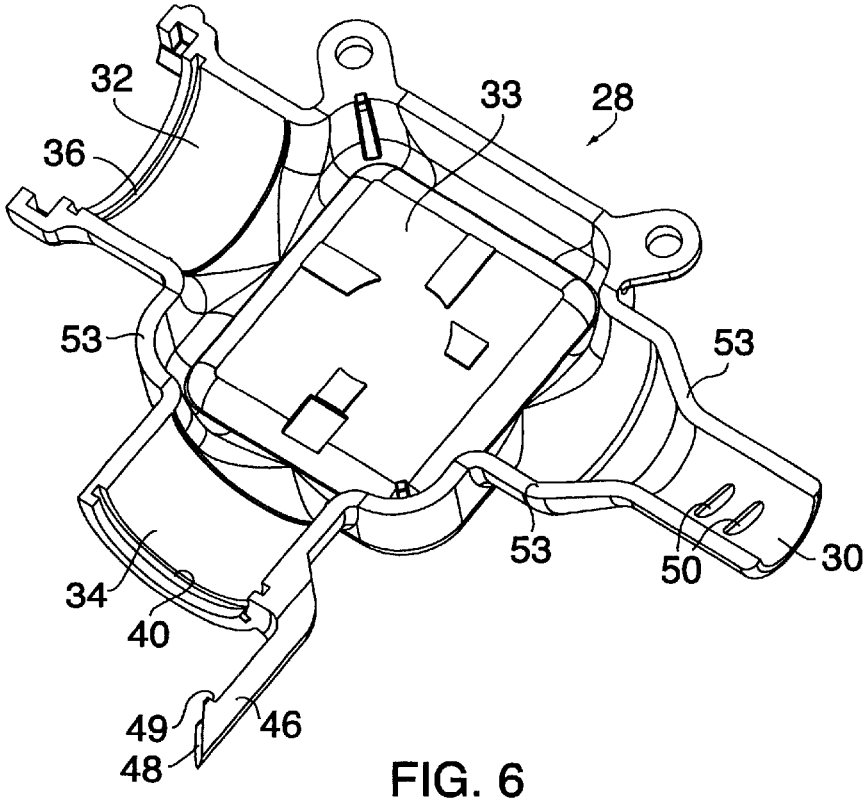
FIG. 6 is similar to FIG. 5 but shows the interior of the housing cover.

Considering now the pre-wired electrical circuit component 10 in further detail, the housing 12, shown in FIG. 3, essentially comprises a hollow rigid thin-walled shell preferably made from a durable resilient dielectric plastic material which is ultrasonically weldable. More specifically, the housing shell is preferably formed by the joinder of two ultrasonically weldable housing sections shown in FIGS. 4–6 and which include a base, indicated generally at 27, and a cover, designated generally by the numeral 28. The cover comprises a near mirror image of the base and cooperates in assembly with the base to define a housing compartment which contains a plurality of power conductors, shown in FIGS. 7–9 and indicated generally and collectively by the numeral 29 in FIG. 8, for connecting the first connecting element 18 and the power supply outlet member 26 to the power supply cable 14 as will be hereinafter further discussed. The two sections of the housing compartment defined by the base 27 and the cover 28 are shown in FIGS. 5 and 6 and indicated, respectively, by the numerals 31 and 33. The housing base and cover further cooperate in assembly to define a generally cylindrical power supply cable inlet opening 30 which communicates with the housing compartment and receives and retains an end portion of the flexible power supply cable 14, a generally cylindrical power supply outlet opening 32 which communicates with the housing compartment and within which the electrical power outlet connector 26 is mounted, and a generally cylindrical circuit selector outlet opening 34 which also communicates with the housing compartment and within which the first connecting element 18 of the circuit selector assembly 16 is supported.

Referring particularly to the housing base 27, shown in FIG. 5, a semi-cylindrical groove 36 is formed in the base 27 near the outer end of the power supply outlet opening 32. A radially inwardly open key slot 38 formed in the housing base 27 extends in a generally axially inward direction from the groove 36 within the power supply outlet opening 32, substantially as shown in FIG. 5. The base 27 also defines a portion of the circuit selector outlet opening 34 which is similar to the power supply outlet opening 32 in that it also includes a radially inwardly open semi-annular groove 40 located near its outer end and a radially inwardly open key slot 42 which extends in an axially inward direction from the groove 40 and toward the housing compartment.

Further referring to the housing 12, as it appears in FIG. 3, the portion of the housing 12 which defines the generally cylindrical circuit selector outlet opening 34 includes two generally diametrically opposed and outwardly extending resilient latch members 44 and 46 for a purpose which will be hereinafter evident. Each of the latch members 44 and 46 has a cam surface 48 at its outer end. The cam surfaces 48,48 are inclined inwardly toward the housing compartment and toward the central axis of the outlet opening 34. Each of the latch members 44 and 46 also has a radially disposed and axially inwardly facing latch surface 49 near its outer end. To facilitate manufacture, the latch member 44 is preferably integrally formed on the base 27, as best shown in FIG. 5, whereas the corresponding latch member 46 is preferably integrally connected to the cover 28, as best shown in FIG. 4. Energy directors 51,51 are integrally formed on and extend along the peripheral edge surface of the base 27 to mate with an opposing substantially flat complementary peripheral edge surfaces 53,53 on the cover 28 when the cover is assembled with the base. The energy director 51,51 are consumed during the welding process when the cover is ultrasonically welded in assembly with the base to form the housing 12 after the various elements which comprise the component 10 have been assembled with the housing.

Figure 8A:
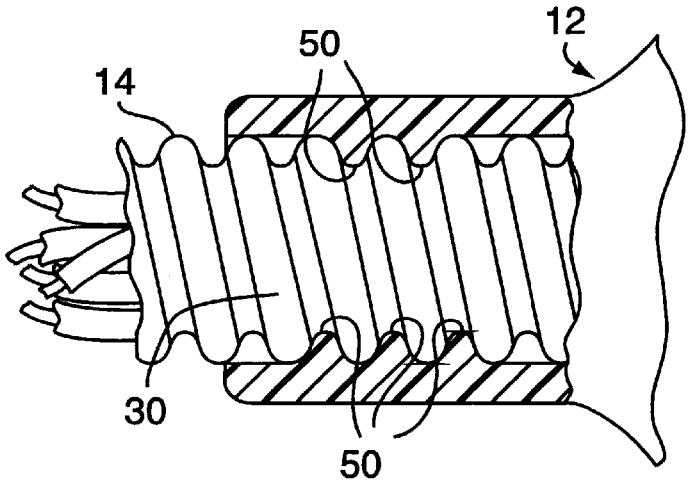
FIG. 8A is a somewhat enlarged fragmentary sectional view taken along the line 8A—8A of FIG. 1.

The housing 12, as shown, is particularly adapted for use with an armored power supply cable 14, such as conventional BX (metal clad) cable, which has a helically convoluted metal outer jacket characterized by helical ridge and valley convolutions and contains at least three individually insulated electrical power supply conductors. A plurality of cable retaining ribs 50,50 are formed within the diametrically opposing semi-cylindrical portions of the housing base 27 and cover 28 which cooperate in assembly to define the cylindrical power supply cable inlet opening 30. The retaining ribs 50,50, shown in FIGS. 5, 6 and 8A, project into and extend axially transversely of the power supply cable inlet opening 30 and are disposed at diametrically opposite sides of and slightly inclined relative to the axis of the cable inlet opening. The retaining ribs 50,50 formed on the cover 28 are slightly offset in an axial direction relative to the retaining ribs formed on the base 27 to be received within convoluted valleys at opposite sides of the outer jacket of the armored power supply cable 14 when the housing 12 is assembled with the cable 14 disposed within the power supply cable inlet opening 30. Thus, the cable retaining ribs 50,50 on the housing base and cover cooperate with the convoluted cable jacket to grip and hold an end portion of the power supply cable 14 in fixed position relative to the housing 12, as best shown in FIG. 8A, and provide strain relief for the cable 14 and the conductors within the cable relative to the housing 12.

As previously discussed, the cover 28 is a near mirror image of the base 27, but, as shown in FIG. 6, the cover does not include key slots corresponding to the key slots 38 and 42 formed in the base. It will also be evident from FIG. 6 that, unlike the base 26, the cover 28 does not have an energy directors formed on its peripheral edge surfaces.

In FIGS. 7 and 9, the electrical circuit component 10, which illustrates the present invention, is shown in a state of partial assembly, before the flexible power supply cable 14 has been connected to the power conductors 29 contained within the housing base 27, and before the housing cover 28 has been assembled with the housing base. The power conductors 29 connect the power outlet connector 26 and the first connecting element 18 to the power supply cable 14 and may take various forms. However, in accordance with presented preferred construction, the power conductors 29, best shown in FIG. 8, comprises a plurality of individual bus bars. The bus bars are blanked and formed from flat metal and have integral spade contacts at terminal portions thereof adapted for plugging connection to associated connecting members carried by the power supply cable 14 connecting members carried by contacts mounted within the power outlet connector 26 and within the first connecting element 18, as will be hereinafter further described. Bus conductors of the type hereinafter generally described are further illustrated and described in U.S. Pat. No. 4,399,371 to Ziff et al. for Modular Wiring System, issued Aug. 16, 1983, assigned to the assignee of the present invention, and hereby adopted by reference as part of the present disclosure.

Figure 8:
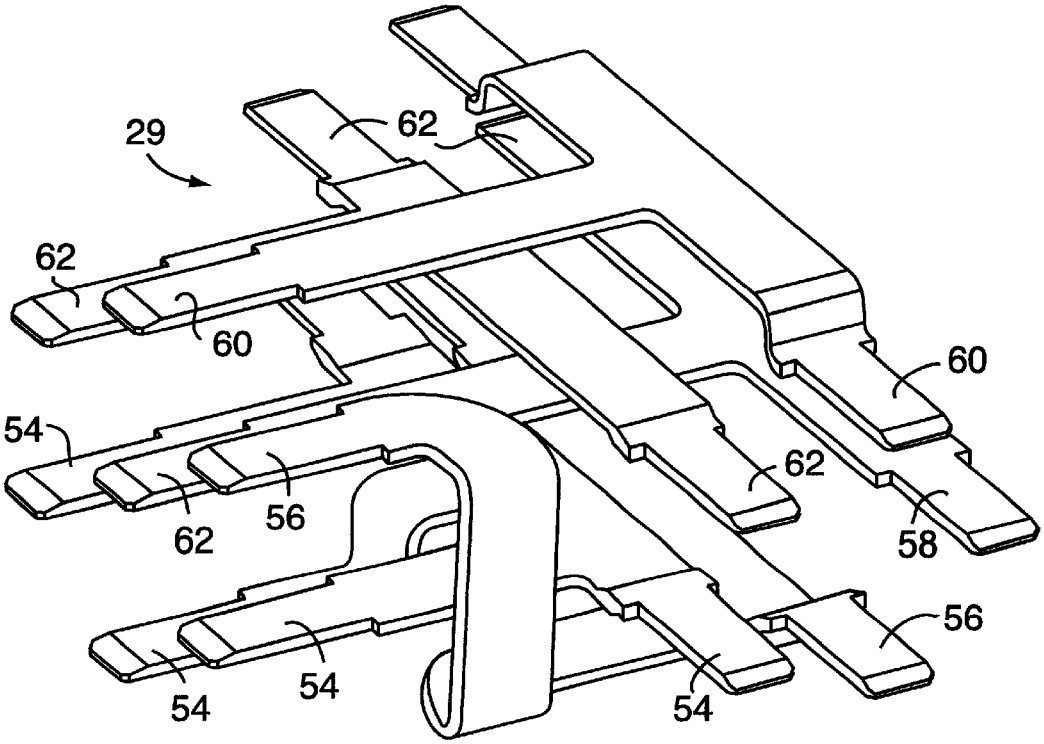
FIG. 8 is a perspective view showing the relative positions of the formed bus bars shown in FIG. 7.
Figure 10:
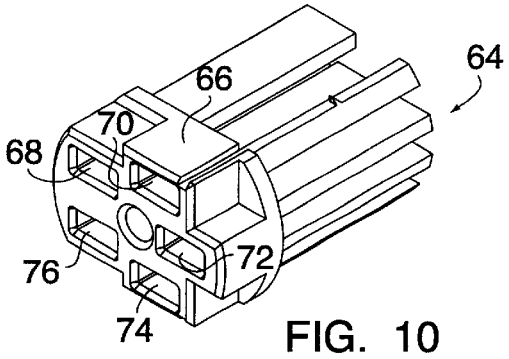
FIG. 10 is a perspective view of the bus bar separator as viewed looking toward the outer end of the separator.
Figure 11:
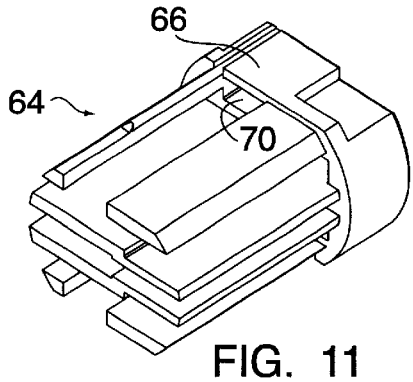
FIG. 11 is a perspective view of the bus bar separator as viewed looking toward the inner end of the separator.

The illustrated power supply cable 14 contains five individually insulated 10 or 12 AWG wire conductors, therefore the connecting circuit components 29 also include five individual formed bus bars indicated at 54, 56, 58, 60 and 62, as best shown in FIG. 8. The bus bars are supported in the housing 12 and separated from each other by a dielectric bus separator indicated generally at 64 in FIGS. 7 and 9 and illustrated in further detail in FIGS. 10 and 11. The bus separator 64 has an outer end wall 66 and a plurality of spaced apart separating walls or partitions integrally connected to the inner end surface of the outer end wall 66 and projecting inwardly therefrom. A plurality of receptacle openings or slots 68, 70, 72, 74 and 76 open outwardly through the outer end wall 66, as shown in FIG. 10, and communicate with spaces between the inwardly extending separating walls. Each of the individual formed bus bars 54–62 are disposed between and separated from the other of the bus bars by associated separating walls of the bus separator 64. A spade contact on a terminal portion of each bus bar is received and exposed within a respectively associated one of the receptacle slots 68–76 in the bus separator 64.

Figure 12:
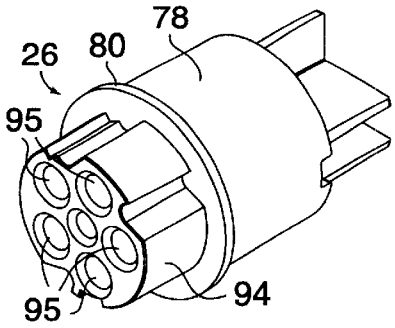
FIG. 12 is a perspective view of a power supply outlet member as viewed looking toward the outer end of the member.
Figure 13:
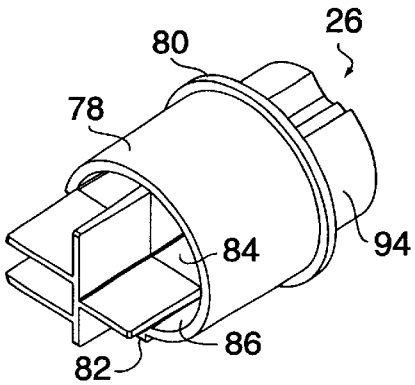
FIG. 13 is similar to FIG. 12 but shows the power supply outlet member of FIG. 11 as viewed looking toward its inner end.
Figure 14:
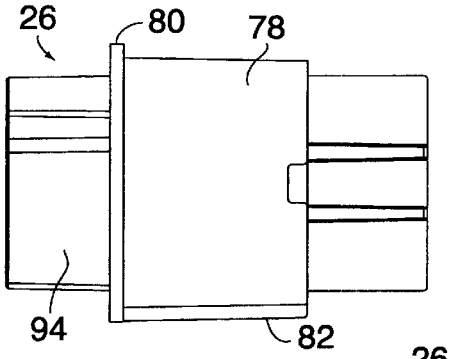
FIG. 14 is a side elevational view of the power supply outlet member shown in FIG. 12.
Figure 15:
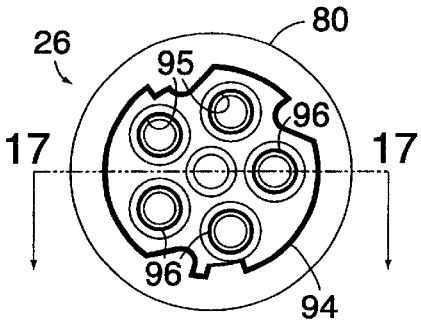
FIG. 15 is an outer end elevational view of the power supply outlet member.
Figure 16:
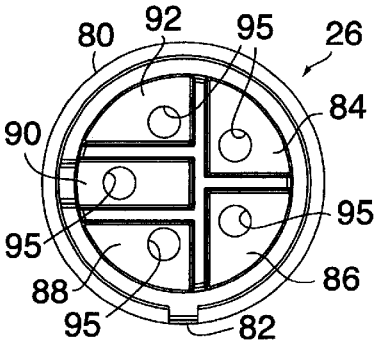
FIG. 16 is an inner end view of the power supply outlet member.
Figure 17:
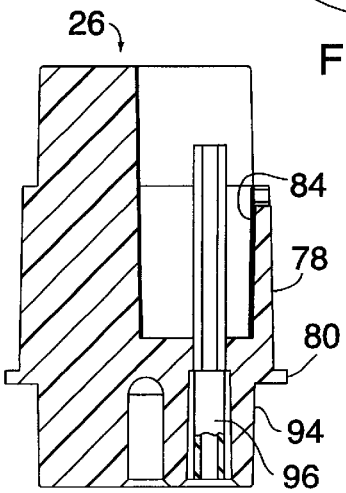
FIG. 17 is a sectional view taken along the line 17—17 of FIG. 15.
Figure 17A:
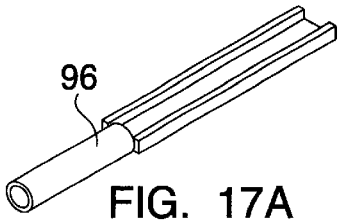
FIG. 17A is a somewhat enlarged perspective view of a socket contact element such as shown in FIG. 17.
Figure 18:
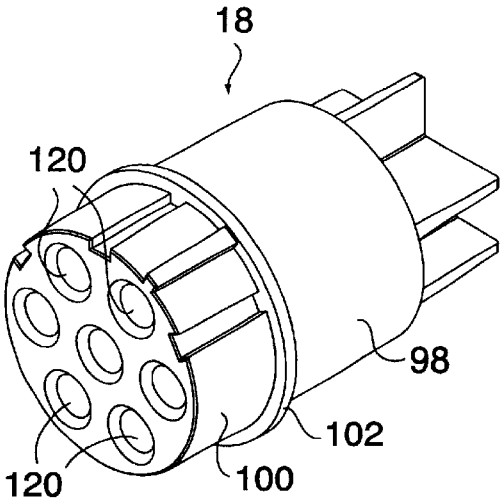
FIG. 18 is a perspective view of a first connecting element as viewed looking toward the outer end of the connecting element.
Figure 19:
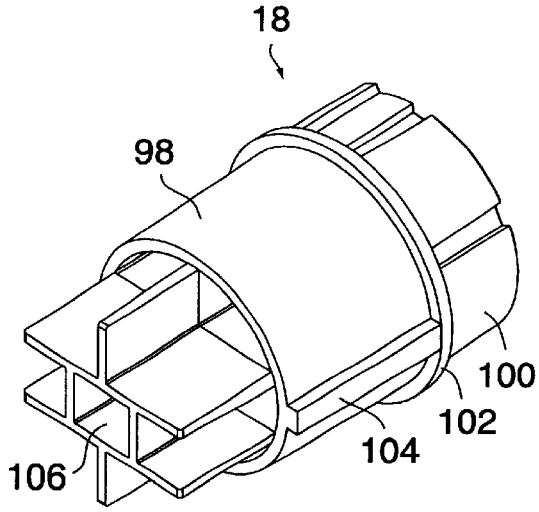
FIG. 19 is a perspective view of the first connecting element shown in FIG. 18 as viewed looking toward the inner end of the connecting element.
Figure 20:
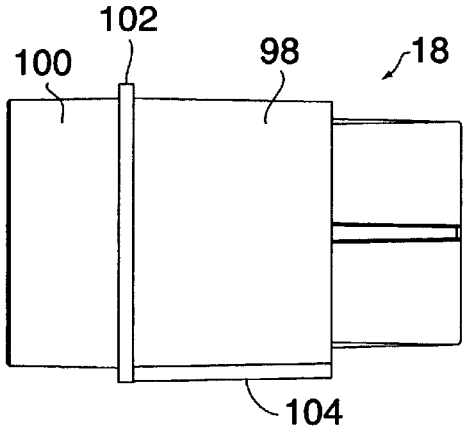
FIG. 20 is a side elevational view of the first connecting element shown in FIG. 18.

The illustrated electrical power supply outlet connector 26, shown in assembly with the housing base 27 in FIGS. 7 and 9 and further illustrated in FIGS. 12–17, has a hollow generally cylindrical body portion 78. An annular flange 80 coaxially surrounds the outer end of the cylindrical body portion 78, projects radially outwardly from it, and is received within the groove 36 in the housing base. A key 82 projects radially outwardly from and extends in an axially inward direction along the body portion 78 from the flange 80, as best shown in FIGS. 14 and 16, and is received within the key slot 38 in the housing base. A plurality of separate compartments 84, 86, 88, 90 and 92, shown in FIG. 16, open inwardly through the inner end of the hollow body portion 78. Compartment walls separate the compartments 84–92 from each other and extend inwardly for some distance beyond the inner end of the cylindrical body 78, as best shown in FIG. 13. The power supply outlet connector 26 further includes a generally cylindrical coaxially outwardly extending male connecting portion 94 which projects coaxially outwardly beyond the annular flange 80. A plurality of generally cylindrical outwardly open contact receiving apertures 95, 95 formed in the male connecting portion 94 are equiangularly spaced about the central axis of the generally cylindrical power supply outlet member 26. An electrical socket contact element 96 is disposed in each of the contact receiving apertures 95,95, as best shown in FIG. 17 The contact elements 96, 96 are equal in number to the number of individual bus bars or power conductors 29. Each socket contact element 96 has a connecting portion at its inner end for sliding connection with a spade contact on a terminal portion of an associated one of the bus bars 54–62. The outer end of each contact element 96 defines a female pin receiving socket, as will be hereinafter further discussed. A typical socket contact element 96 used in practicing the invention is illustrated in FIG. 17A. The power outlet connector 26 is preferably color coded and safety keyed to prevent accidental voltage mismatching and for this reason the male connecting portion 94 has a plurality of uniquely shaped key slots which open through its outer surface, as best shown in FIGS. 7, 12 and 15.

As previously noted, the rotational circuit selector assembly 16 which includes the first connecting element 18 also includes the second connecting element 20. The second connecting element is constructed and arranged for connection in mating engagement with the first connecting element 18, as shown in FIG. 1, and may be connected to the first connecting element in a selected one of a plurality of differing angular positions to provide power at a selected available voltage to the cord drop 23 to satisfy the operational requirement of a particular type of lighting fixture.

Figure 21:
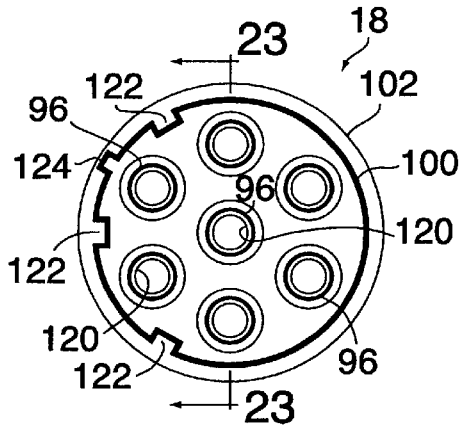
FIG. 21 is an outer end view of the first connecting element.
Figure 22:
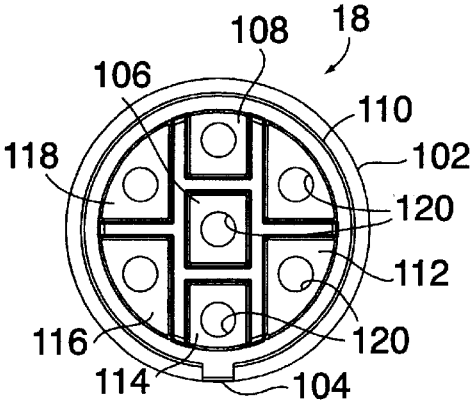
FIG. 22 is an inner end view of the first connecting element.
Figure 23:
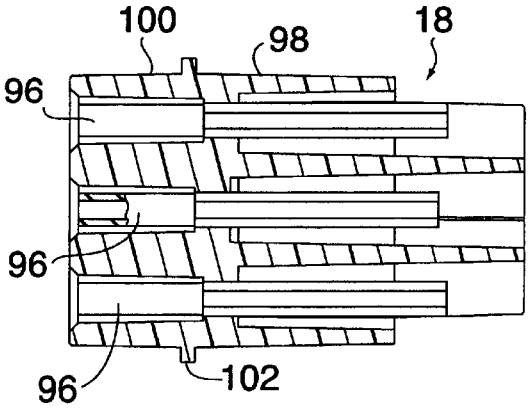
FIG. 23 is a sectional view taken along the line 23—23 of FIG. 21.
Figure 24:
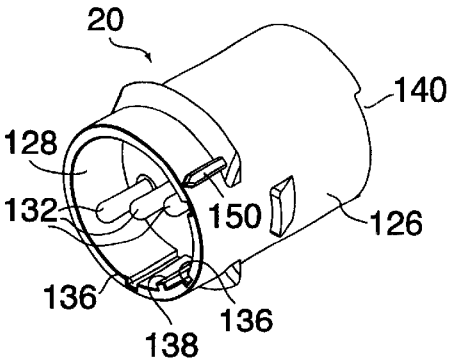
FIG. 24 is a perspective view of a second connecting element as viewed looking toward the inner or plugging end of the connecting element.
Figure 25:
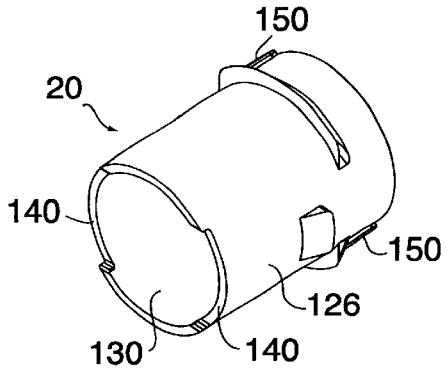
FIG. 25 is similar to FIG. 24 but shows the outer end of the second connecting element of FIG. 24.
Figure 26:
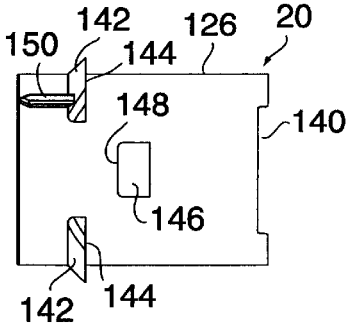
FIG. 26 is a side elevational view of the second connecting element.
Figure 27:
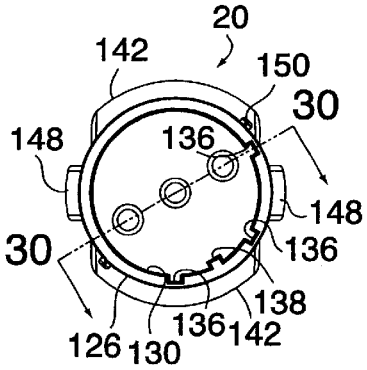
FIG. 27 is an inner end view of the second connecting element.
Figure 28:
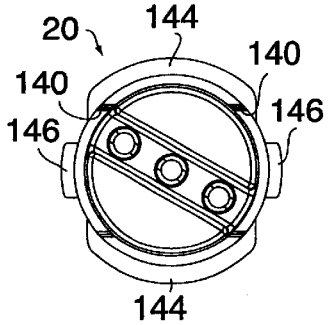
FIG. 28 is an outer end view of the second connecting element.
Figure 29:
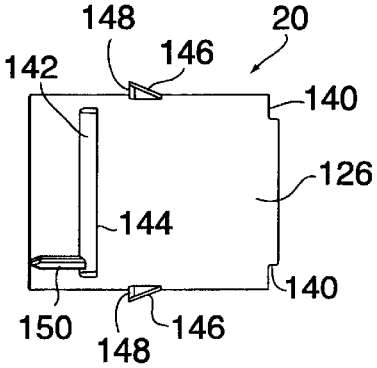
FIG. 29 is a top plan view of the second connecting element as it appears in FIG. 26.

The first connecting element 18, shown in FIGS. 7 and 9 and illustrated in further detail in FIGS. 18–23, is similar in many respects to the power supply outlet member 26, previously described. Like the power supply outlet member 26, the first connecting element 18 has a generally cylindrical body, indicated at 98, which is hollow at its inner end and has an axially outwardly extending male connecting portion 100 surrounded at its inner end by an annular flange 102 which is received within the housing groove 40. A key 104 projects radially outwardly from the body portion 98, extends in an axially inward direction and along the body 98 from the flange 102 and is received in the key slot 42 formed in the housing base, whereby the first connecting element 18 is secured against rotation relative to the housing 12. A plurality of substantially parallel compartment walls disposed within the hollow body portion 98 project inwardly for some distance beyond the body portion 98 and cooperate with the body portion to define seven separate inwardly open compartments 106, 108, 110, 112, 114, 116 and 118 for receiving seven terminal portions of the bus bars 54–62. As in the previously described power supply outlet member 26, the first connecting element 18 has a plurality of generally cylindrical outwardly open contact receiving apertures 120, 120. Each aperture 120 opens into an associated one of the compartments 106–118. The apertures 120, 120 are symmetrically arranged about the central axis of the first connecting element 18 to facilitate coaxial plugging engagement with the mating second connecting element 20 in a plurality of differing angular positions of connection. The presently preferred arrangement of the apertures 120, 120 is best shown in FIGS. 21 and 22 wherein a coaxial central aperture 120 is shown surrounded by six other identical equiangularly spaced apart apertures. Each aperture 120 opens into an associated one of the compartments 106–118 within the body 98, as best shown in FIG. 22, wherein the inner end of the first connecting element 18 is shown.

Seven contact members 96, 96, such as previously described, are received and supported within the seven apertures 120, 120. The inner or connecting end of each contact 96 is slidably connected in electrically contacting engagement to a terminal portion of an associated one of the one of the bus bars 29 within the first connecting element 18. The socket defining portions of the contact elements 96, 96 are exposed within the apertures 120, 120 which open through the outer end of the male connecting portion 100. The preferred arrangement of the pin receiving sockets which comprise the contact elements 96, 96 is shown in FIG. 21 wherein a central pin receiving socket is coaxially surrounded by six equiangularly spaced apart pin receiving sockets. The male connecting portion 100 of the first connecting element 18 is keyed for connecting engagement with a female connecting portion of the second connecting member 20 in three different possible positions of connected engagement, and for this reason three axially parallel and radially outwardly open keyways 122, 122 are formed in the male portion 100. An axially parallel key 124 is also provided and projects radially outwardly from the male portion 100 for the same reason, as will be hereinafter discussed.

The power conductors or electrical buses 29, the bus separator 64, the power supply cable 14, the power supply outlet member 26 and the first connecting element 18, comprise a preassembled core assembly which is received as a unit within the housing base 27. The flange 80 and the key 82 on the power supply outlet member 26 are respectively positioned within and substantially complement the groove 36 and the keyway 38 formed in the power supply outlet portion of the housing base. In like manner, the first connecting element 18 is positioned within the housing base 27 with the flange 102 received within and substantially complementing the groove 40 and the key 104 received within and substantially complementing the key slot 42. The electrical connectors on the individual conductors which comprise the power supply cable 14 are connected to terminal portions of the bus bars within the receptacle openings 68–76 in the bus separator after which an end portion of the convoluted outer jacket on the armored power supply cable 14 is positioned within the housing base with the cable retaining ribs 50, 50 on the base disposed within valleys between adjacent ridge convolutions of the armored outer jacket of the cable 14. When the bus separator 64 is properly positioned within the base 26, the inwardly extending end portions of the compartment walls on the first and second power outlet connectors 16 and 18 cooperate with the separating walls on the bus separator 64 to further isolate the individual electrical buses which collectively comprise the power conductors 29.

After the aforesaid core assembly has been assembled with the housing base 27, the housing cover 28 is positioned on and in proper alignment with the base. The assembly is completed by ultrasonically welding or otherwise joining the housing cover 28 to the base 27. The annular flanges and the keys on the first connecting element 18 and on the power supply outlet member 26 cooperate with the respectively associated grooves and keyways in the housing to secure the first connecting element 18 and the power supply outlet member 26 in fixed position within and relative to the housing 12. The cable retaining ribs 50, 50 on the housing base 27 and the housing cover 28 cooperate to secure an end portion of the armored power supply cable 14 to the circuit component housing 12 and provide internal strain relief for the power supply cable 14 within and relative to the housing.

It should be noted that the housing base 27 and the housing cover 28 cooperate in assembly to form a pair of ears 125, 125 which project from the housing 12 at diametrically opposite sides of the power supply outlet opening 32. The ears define opposing radially inwardly open latch receiving recesses, as best shown in FIGS. 1 and 3, for receiving latch members associated with another connecting member (not shown) adapted for mating connection with the power supply outlet member 26 to receive power therefrom. A raised generally hemispherical shaped dimple 127 is formed on one of the ears 125, as best shown in FIG. 1. The dimple is oriented in proximity to an aperture indicated at 120G which contains a grounded electrical contact 96. The dimple provides a tactile indicator for enabling an installer to quickly locate the position of the grounding aperture on the power supply outlet member 26 by "feel", if necessary. In like manner, raised letters A, B and C formed on the housing 12 proximate the circuit selector outlet opening 34, and shown in FIG. 1, provide tactile means to aid an installer to properly connect the second connecting element 20 to the first connecting element 18 in selected phase position by "feel" when the location of the component housing 12 renders visual observation of the possible phase positions of connection difficult, if not impossible.

Figure 30:
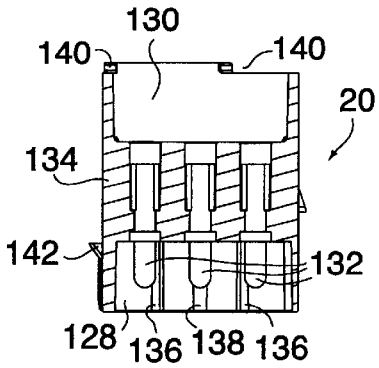
FIG. 30 is a sectional view taken along the line 30—30 of FIG. 27.
Figure 31:
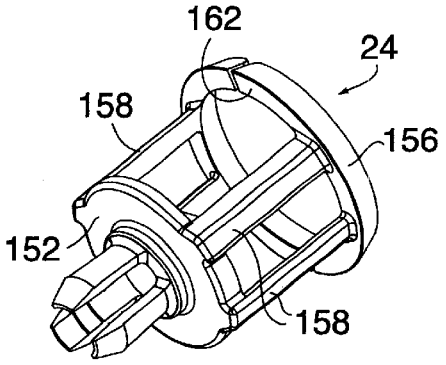
FIG. 31 is a perspective view of the strain relieving device as viewed looking toward the outer end of the device.
Figure 32:
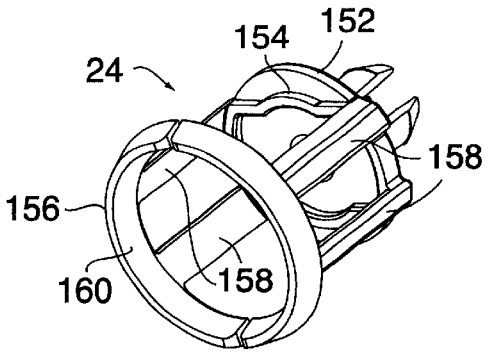
FIG. 32 is a perspective view of the strain relieving device shown in FIG. 31 as viewed looking toward the inner end of the device.
Figure 33:
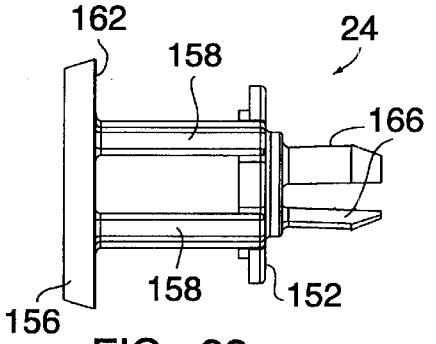
FIG. 33 is a side elevational view of the strain relieving device.
Figure 34:
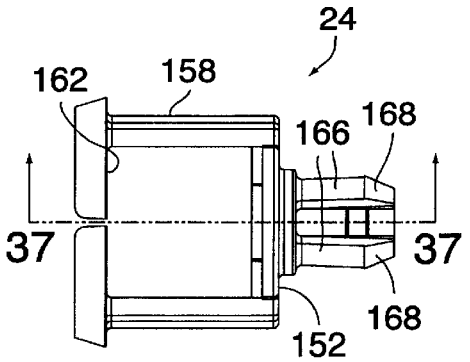
FIG. 34 is a top plan view of the strain relieving device as shown in FIG. 33.
Figure 35:
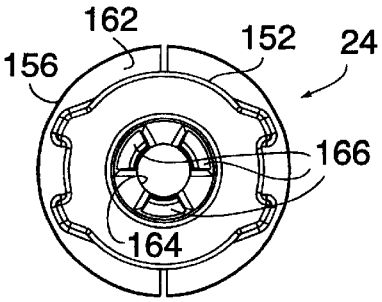
FIG. 35 is an outer end view of the strain relieving device.
Figure 36:
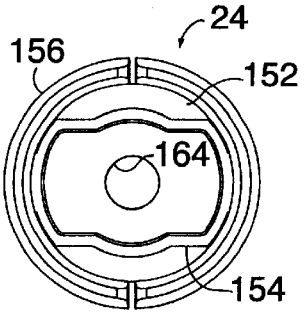
FIG. 36 is an inner end view of the strain relieving device.
Figure 37:
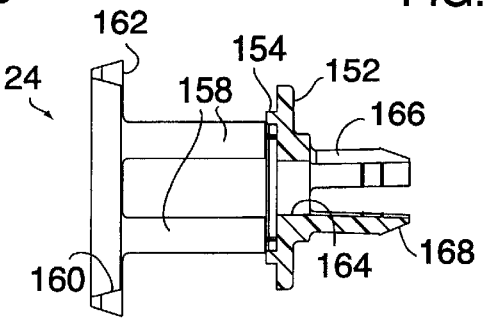
FIG. 37 is a sectional view of the strain relieving device taken along the line 37—37 of FIG. 34.
Figure 38:
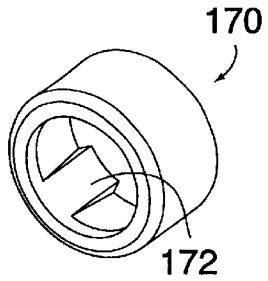
FIG. 38 is a perspective view of the cord retainer snap ring as viewed looking toward the outer end of the ring.
Figure 39:
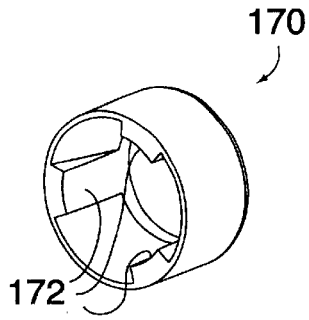
FIG. 39 is a perspective view of the cord retainer snap ring shown in FIG. 38 as viewed looking in the direction of the inner end of the ring.
Figure 40:
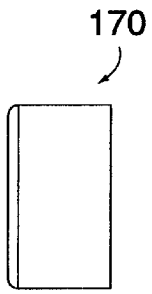
FIG. 40 is a side elevational view of the cord retainer snap ring.
Figure 41:
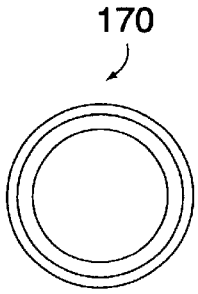
FIG. 41 is an outer end elevational view of the cord retainer snap ring.
Figure 42:
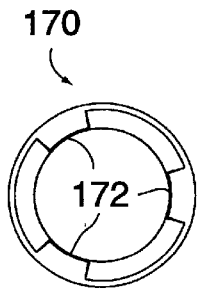
FIG. 42 is an inner end elevational view of the cord retainer snap ring.

The cord drop assembly 22, which comprises part of the rotational circuit selector assembly 16 and which includes the second connecting element 20, the cord drop 23 and the stress relieving device 24, is adapted for connection to the first connecting element 18 in any one of three possible positions of connection to facilitate appropriate phase, neutral and ground connection and to thereby supply power at a selected available voltage to an associated lighting fixture F, such as shown in FIG. 2. Further considering the illustrated cord drop assembly 22, the second connecting element 20, shown in a connected condition in FIG. 1 and in somewhat further detail in FIGS. 24–30, essentially comprises a unitary generally cylindrical body 126 which has a generally cylindrical axially outwardly open blind bore 128 at its inner or connecting end and a generally cylindrical axially outwardly open blind recess 130 at its opposite or outer end. Three male pin contact elements 132, 132 are mounted in fixed position within associated contact receiving apertures formed in and extending through an integral axially central dividing wall 134 which separates the bore 128 from the recess 130, as best shown in FIG. 30. Each pin contact element 132 has a contact pin on one end which terminates within the bore 128. The other end of each contact element 132 forms a connector for slidably receiving an associated spade contact, as herein before discussed with respect to the contacts 96, 96. The three pin contact elements 132, 132 are mounted in the body 126 in diametric alignment with each other, the central contact element being in axial alignment with the cylindrical body 126, as best shown in FIGS. 27–30. Three axially parallel keyways 136, 136 formed in the body 126 open into the bore 128 and through the inner end of the body to receive the key 124 on the male or plugging portion 100 of the power outlet connector 18. A single key 138 oriented in parallel relation to the keyways 136, 136 and projects radially into the bore 130 and is arranged to be received in any one of the three keyways 122, 122 in the first connecting element 18 when the two mating connectors 18 and 20 are joined in plugging relation to each other. The length of the contact pins on the contact elements 132, 132 on the second connecting element 20 and the position of the sockets on the socket contacts 96, 96 carried by the first connecting element 18 is arranged so that the contact pins cannot enter and make electrical contact with the socket contacts 96, 96 until the second connecting element 20 has been partially assembled with the first connecting element 18. Thus, the male portion of the first connecting element 18 must be partially disposed within the bore 128 of the second connecting element 20 before circuit connection can be made. Thus any arcing which may occur, as for example by separating the pin contact elements 132, 132 from the socket contacts 96,96 under a load condition, will be shielded or shrouded by the outer wall portion of body 126 which defines the bore 128, thereby protecting the installer from possible injury.

Further considering the second connecting element 20, a pair a diametrically opposed and axially outwardly open shallow notches 140, 140 are formed in the outer end of the body 126, for a purpose to be hereinafter discussed. A pair of diametrically opposed arcuate first keepers 142, 142 project radially outward from the body 126 and subtend arcs of about ninety degrees about the axis of the body at opposite sides of the body 126. The first keepers define radially disposed axially outwardly facing abutment surfaces 144, 144 which lie within a common radial plane relative to the body. A pair of diametrically opposed second keepers 146, 146 project radially outward from the body and define a pair of radially disposed axially inwardly facing bearing surfaces 148, 148 which lie within a common plane spaced in an axial direction from the plane of the abutment surface 144, 144. The first and second keepers 142, 142 and 146, 146 cooperate with the strain relieving device 24 as hereinafter discussed. A raised indicating member or pointer 150 integrally formed on the outer surface of the body 126 and oriented relative to the pin contact elements 132, 132 cooperate with the raised letters A, B and C on the housing 12 to provide the tactile means for enabling an installer to properly position the first and second connecting elements 18 and 20 to supply a selected available operating voltage to an associated lighting fixture.

The illustrated cord drop 23 has a smooth generally cylindrical outer jacket made from a resilient dielectric plastic or rubber compound and contains three individually insulated 10 or 12 AWG electrical conductors. Each conductor has a spade contact element crimped or otherwise secured to its free end for plugging connection with an associated connecting portion of one of the pin contact elements 132, 132 within the second connecting element 20.

Referring now to FIGS. 31–37, the stress relieving device 24 carried by the second connecting member 20 comprises a cage-like member which has a generally circular outer end wall having a diameter substantially equal to the outside diameter of the second connecting member body 126. A key 154 formed on the inner surface of the outer end wall 152 is adapted to be received within and generally complement the outer end portion of the cylindrical recess 130. Diametrically opposite outer end portions of the key 154 are disposed within the notches 140, 140 to restrain the stress relieving device 24 against angular movement relative to the second connecting element body 126. A generally circular split retaining ring 156 is integrally connected to the end wall 152 by a plurality of elongated parallel retaining members 158, 158 integrally connected to the end wall 152 and to the retaining ring 156 and extending therebetween. The retaining ring 156 has an inner surface 160 defined by a conically axially inwardly diverging surface of revolution. The minor diameter of the inner surface 160 is substantially equal to the outside diameter of the cylindrical body 126. The thickness of the ring, measured in an axial direction, is substantially equal to the axial distance between the abutment surface 144 and the bearing surface 148 defined by the keepers on the second connecting element 20. The retaining ring 156 further includes a generally radially disposed outwardly facing seating surface 162.

A generally cylindrical coaxial aperture 164 extends through the end wall 152 and is sized to slidably receive the cord drop 23 therethrough. A plurality of resilient spring fingers 166 integrally connected to the end wall 152 in equiangularly spaced relation to each other about the central axis of the end wall and around the aperture 164 project axially outwardly from the end wall in generally parallel relation to each other. The spring fingers 166, 166 are adapted to lie along an outer surface of the cord drop 23 when the end portion of the cord drop 23 which carries the spade contacts is assembled with the strain relief device 24. Each spring finger 166 detail has an axially outwardly and radially inwardly inclined cam surface 168 at its axial outer end.

A cord retainer snap ring, shown in detail in FIGS. 38–42 and indicated generally at 170, comprises a part of the stress relieving device 24 and is adapted to be received on the cord drop 23. The snap ring 170 contains a plurality of equiangularly spaced integral cams which define cam surfaces 172, 172 equal in number to the cam surfaces 168, 168 defined by the spring fingers.

The cord drop assembly 22 which includes the second connecting element 20, the cord drop 23 and the stress relieving device 24 is assembled by first inserting the end of the cord drop 23 which carries the spade contacts through the cord retainer snap ring 170, through the aperture 164, and through the retaining ring 156. Thereafter, the spade contacts on the cable drop conductors are slidably connected to the connecting end portions of the pin contact elements 132, 132, which are accessible within the recess 130. After the aforesaid electrical connections have been established the cage-like stress relieving member 24 which includes the split retaining ring 156 and the end wall 152 is slipped onto the second connecting element body 126.

The inner cam surfaces 160, 160 on the split retaining ring 156 engage inclined cam surfaces on the second keepers 146, 146 causing the retaining ring to snap over the second keepers and assume a position between the first keepers 142, 142 and the second keepers 146, 146 wherein the seating surface 162 on the ring bears against the bearing surfaces 148, 148. The key 154 is received within the recess 130 and the outer end portions of the key 154 are received within and generally complement the notches 140, 140, so that the end wall 152 forms a closure for the outwardly open recess i130. The assembly is completed by moving the cord retainer snap ring 170 along the cord drop 23 to bring the cam surfaces 172, 172 on the snap ring into coengagement with the cam surfaces 168, 168 on the spring fingers 166, 166. The snap ring is moved inwardly onto the spring fingers 166 and assumes a position of snap engagement with the fingers wherein the ring 170 continuously urges the spring fingers 166, 166 into gripping engagement with the resilient outer jacket of the cord drop 23. Thus, strain relief is established between the cord drop 23 and the second connecting element 20. The opposite or free end of the flexible cord drop 23 may be connected to an associated lighting fixture, such as the fixture F, by any suitable means.

After the part of the pre-wired component 10 which includes the housing 12 has been mounted in a fixed position in a flexible wiring system, such as the systems shown in FIG. 2, the power supply cable 14 is connected to a power supply source by any suitable means. Thus, for example, the power supply cable 14 may be terminated in a conventional manner within the junction box B or may be connected to the box B by releasably connected mating male and female connecting members in a manner well known in the art.

The installation of the lighting fixture F is completed by releasably connecting the second connecting element 20 to the mating connecting element 18 in a selected one of the three possible positions of connection indicated by the letters A,B and C on the housing to provide the required voltage to operate the fixture, each position of connection providing a different output voltage.

If the mounting position of the housing 12 is such that the raised letters A, B and C and the raised pointer 150 are not readily visible to the installer the position of the pointer relative to the desired position of connection can readily be determined by feeling the raised letters on the housing and the pointer and aligning the raised pointer 150 in the selected position and moving the connecting element 20 into connected engagement with the connecting element 18. As previously noted the electrical contacts to be connected cannot be brought into electrical contacting engagement until the connecting elements 18 and 20 are partially assembled so that any electrical arcing which may occur during the assembly process will be confined within the bore 128 thereby protecting the installer from possible risk of injury. As the connecting element 20 is moved into engagement with the stationary connecting element 18 the retaining ring 158 engages the cam surfaces 48, 48 on the resilient latches 44 and 46 carried by the housing 12 causing the latches to be cammed radially outwardly and into snap engagement with the retaining ring 156. When electrical connection has been properly established the axially inwardly facing surfaces 49, 49 on the latches snap into engagement with the seating surface 162 on the retaining ring 156 to releasably secure the second connecting element in connected engagement with the first connecting element 16.

It will now be apparent that the stress relieving device 24 performs three important functions, namely it provides a closure for the recess 130 which facilitates assembly of the cord drop 23 and maintenance, if necessary, it provides strain relief in the cord drop 23 relative to the second connecting element 20, and it releasably secures the cord drop assembly 22 in a selected position of connection with the first connecting member 18 and relative to the housing 12.

When one or more additional lighting fixtures is to be added to a flexible wiring system to extend the system, as, for example, by adding the fixture $F_1$ to the system S shown in FIG. 2 and which includes the pre-wired component 10 which supplies power to the fixture F, an additional component 10*a* is provided. The component 10*a* is substantially identical to the previously described component 10, but differs from the component 10 in that the power supply or extender cable 14*a* is terminated by a connector identified by the letter C in FIG. 2 and keyed for mating plugging connection with the power supply outlet member 26 on the component 10. The connector C (not shown in detail) preferably includes latches for releasable engagement with the ears 125, 125 associated with the power supply outlet member 26, whereby the connector C is releasably connected to the outlet member 26. The dimple 127, previously discussed, provides a tactile means for enabling an installer to readily identify the position of the electrical grounding contact on the power supply outlet member 26 by feel if the mounting position of the pre-wired component 10 renders visual observation of the grounding position difficult, if not impossible. Power received from the component 10 is thereby supplied to the fixture $F_1$ by the component 10*a*. The system S is further extended by the addition of the component 10*b* which receives power from the component 10*a* to operate the fixture $F_2$. Each additional prewired circuit component is added to-the system by plugging it into a power supply outlet member on a preceding component in the system.

Referring now to FIG. 43–48, another pre-wired circuit component embodying the invention is indicated generally at 10*c*. The illustrated component 10*c* is particularly adapted for use in a flexible wiring system which has a main circuit and which may also include a branch circuit. The branch circuit may comprise a part of the initial flexible wiring system installation or may be added to the main circuit at sometime in the future, as may be required.

The component 10*c* is, in most respects, substantially identical to the component 10 previously described. Parts of the component 10*c* which are substantially identical to corresponding parts of the previously described component 10 bear the same reference numeral as the previously described component and a letter "c" suffix and will not be hereinafter further described.

The component 10*c* differs from the component 10 in that it includes a plurality of power supply outlet members 26*c* and 26*c*. Each of the power supply outlet members 26*c*, 26*c* includes contacts electrically connected to terminal portions of bus connectors (not shown) contained within the housing 12*c*, substantially as aforedescribed with reference to the busses or power conductors 29 of the component 10. One of the two power supply outlet members 26*c*, 26*c* may be connected with another pre-wired component to form a main circuit. Another of the power supply outlet members 26*c*, 26*c* may be connected to another pre-wired component to form a branch circuit or may remain in an unconnected condition to provide for future expansion of the flexible wiring system.

The circuit component 10*c* further differs from the previously described component 10 in that it includes a flexible power supply cable 14*c* which includes an outer jacket made from a dielectric rubber or plastic compound and has a uniform circular cross section throughout its length. The power supply inlet opening indicated at 30*c* (FIG. 44) is substantially identical to the power supply inlet opening 30 previously described, and includes transversely extending ribs indicated at 50*c*, 50*c*. Thus, the housing 12*c* is adapted to accommodate an armored power supply cable or BX (metal clad) cable as previously described with reference to the component 10. However, the illustrated pre-wired component 10*c* is provided with a flexible power supply cable which includes an insulated outer jacket, shown at 14*c* in FIG. 43. A generally cylindrical tubular insert or sleeve 174 is positioned within the power supply inlet opening 30*c* to compensate for the difference in outside diameter between the armored jacket on a metal cable and the somewhat smaller insulation jacket on the cable 14*c*. The insert or sleeve 174, shown in some detail in FIGS. 46–48 essentially comprises a split generally cylindrical tubular sleeve which has radially outwardly directed flanges 176, 178 and 180 at its inner end and a radially disposed and radially inwardly projecting rib coaxial 182 spaced inwardly from its outer end. The sleeve is relieved at diametrically opposite sides which forms slots indicated at 184 and 186 to accommodate the ribs 50*c*—50*c* when the sleeve is positioned within the power supply inlet opening 30*c* as it appears in FIGS. 44 and 45. Thus, when the housing 12*c* is assembled with the insert 174 and the cable 14*c* positioned therein the ribs 50*c*, 50*c* are exposed at the slots 184 and 186 and inwardly beyond the cylindrical inner surface of the insert 176 and grippingly engage and deform the outer surface of the resilient outer jacket of the cable 14*c* to provide strain relief for the cable 14*c* within and relative to the housing 12*c*. The flanges 176, 178 and 180 cooperate with the ribs to anchor the sleeve in fixed position within and relative to the housing 12*c*. The rib 179 grippingly engages the cable and provides a general moisture seal near the outer end of the power inlet opening 30*c*.

Figure 43:
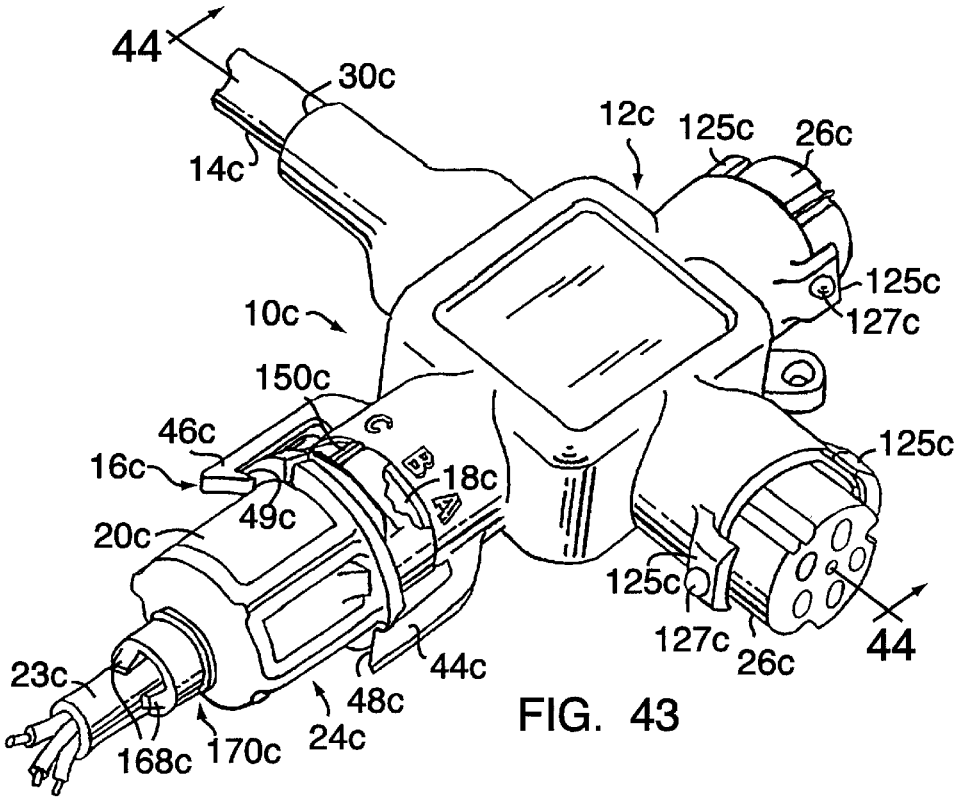
FIG. 43 is a perspective view of another pre-wired circuit component and illustrates another embodiment of the invention.
Figure 44:
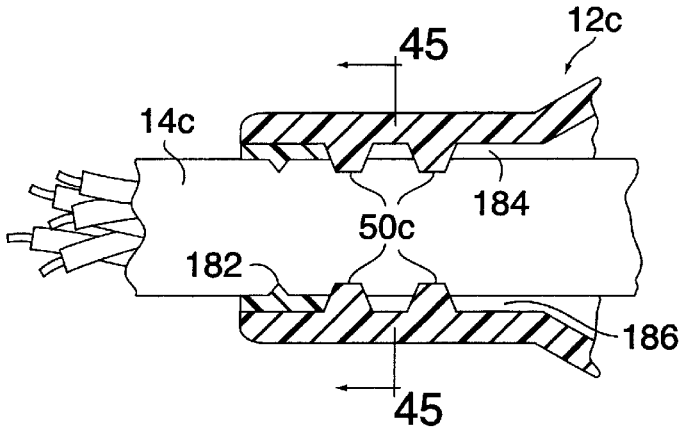
FIG. 44 is a somewhat enlarged fragmentary sectional view taken along the line 44—44 of FIG. 43 with the power supply cable shown in full.
Figure 45:
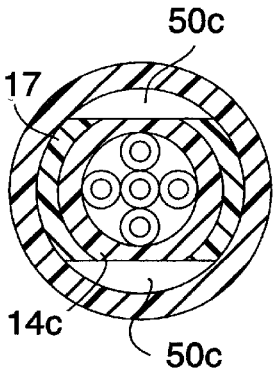
FIG. 45 is a sectional view taken along the line 45—45 of FIG. 44.
Figure 46:
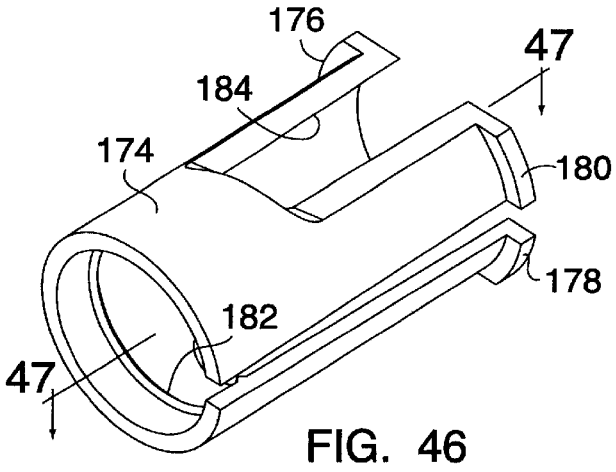
FIG. 46 is a perspective view of a cable sleeve insert viewed looking toward the outer end of the insert.
Figure 47:
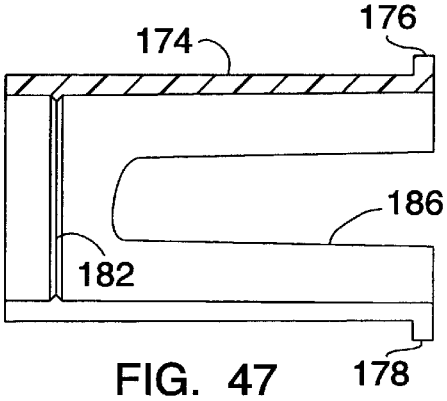
FIG. 47 is a sectional view taken along the line 47—47 of FIG. 46.
Figure 48:
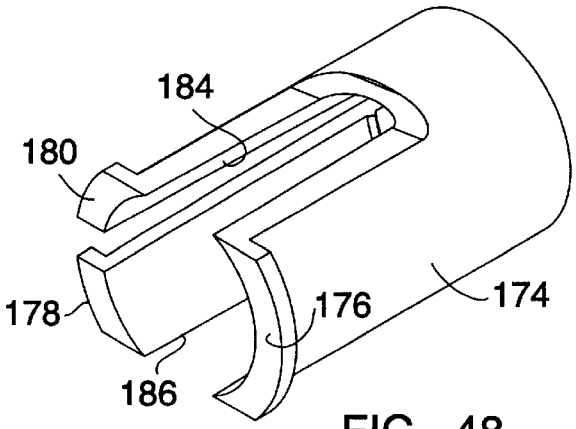
FIG. 48 is a perspective view of the cable sleeve insert of FIG. 46 as viewed looking toward the inner end of the insert.

In the illustrated embodiments of the invention shown in FIGS. 1 and 43, a power supply outlet is shown at the 3 o'clock position on the housing whereas the rotational circuit selector is shown at the 6 o'clock position, and the power inlet cable appears at the 9 o'clock position as viewed from above. However, it should be understood that other mounting arrangements of the components on the housing are contemplated as being within the scope of the present invention.

We claim:

1. A pre-wired circuit component for a flexible wiring system comprising;

a housing defining a power inlet opening and a power outlet opening, an elongated flexible power supply cable for connection to a power supply source and extending into said housing through said power inlet opening, and a rotational power outlet selector assembly including a generally cylindrical first connecting element mounted in fixed position within said outlet opening, connecting means for electrically connecting said first connecting element to said power supply cable within said housing to receive power from said power supply cable, said rotational power outlet selector assembly further including a cord drop assembly having a flexible cord drop and a generally cylindrical second connecting element connected to said cord drop for releasable coaxial electrical plugging connection to said first connecting element to supply power received from said power supply cable to said cord drop, said second connecting element being electrically connectable to said first connecting element in a selected one of a plurality of possible connected positions angularly spaced apart about the axis of said first connecting element, said power supply cable delivering power to said cord drop at a substantially different voltage at each of said connected positions, said cord drop assembly further including first strain relieving means for relieving strain in said cord drop relative to said second connecting element.

2. A pre-wired circuit component as set forth in claim 1 wherein said first strain relieving means includes retaining means for releasably securing said second connecting element in mating connected engagement with said first connecting element in each of said connected positions.

3. A pre-wired circuit component as set forth in claim 2 wherein said second connecting element has an inner end connectable to said first connecting element and an outer end defining an outwardly open recess and said first strain relieving means includes closing means for forming a substantial closure for said recess when said second connecting element is connected in engagement with said first connecting element.

4. A pre-wired circuit component as set forth in claim 3 wherein said retaining means includes a retaining ring substantially coaxially encircling said cylindrical second connecting element and defining a keeper and said housing includes a pair of diametrically opposed outwardly projecting latches engageable with said keeper.

5. A pre-wired circuit component as set forth in claim 3 wherein said closing means comprises an end wall, said cord drop extends through an aperture in said end wall and into said recess, and said first strain relieving means includes cord gripping means for securing said cord drop to said end wall.

6. A pre-wired circuit component as set forth in claim 5 wherein said cord gripping means comprises a plurality of resilient fingers projecting outwardly from said end wall and a cord retainer snap ring receiving said cord drop therethrough and disposed in snap-on connection with said fingers and continuously urging said fingers into gripping engagement with said cord.

7. A pre-wired circuit component as set forth in claim 3 wherein said second connecting element has a generally cylindrical body and a plurality of second keepers projecting generally radially outwardly therefrom and said first strain relieving means includes a retaining ring disposed in substantial coaxial surrounding engagement with said body and retained on said body by said second keepers.

8. A pre-wired electrical component as set forth in claim 7 wherein said first strain relieving means is disposed in snap-on assembly with said second connecting element.

9. A pre-wired electrical component as set forth in claim 8 wherein said retaining ring is further characterized as a split ring.

10. A pre-wired electrical component as set forth in claim 7 wherein said retaining means comprises a pair of resilient latches projecting outwardly from said housing at generally diametrically opposite sides of said outlet opening and said latches are releasably engagable with said retaining ring.

11. A pre-wired circuit component as set forth in claim 10 wherein said first strain relieving means includes attaching means for a connecting said closing means to said retaining ring.

12. A pre-wired circuit component as set forth in claim 11 wherein said closing means includes an end wall and said attaching means comprises a plurality of elongating members integrally connecting to said end wall and said to retaining ring and extending therebetween.

13. A pre-wired circuit component as set forth in claim 1, wherein said power inlet opening comprises a generally cylindrical opening and said circuit component includes second strain relieving means for engaging said power supply cable within said power inlet opening to relieve stress in said power supply cable within and relative to said housing.

14. A pre-wired circuit component as set forth in claim 13 wherein said second strain relieving means includes a plurality of ribs integrally formed on said housing and projecting into said power inlet opening.

15. A pre-wired circuit component as set forth in claim 14 wherein said power supply cable has a outer jacket characterized by helical ridge and valley convolutions and each of said ribs is disposed within a valley convolution and between associated rib convolutions.

16. A pre-wired circuit component as set forth in claim 15 wherein said power supply cable comprises a BX (metal clad) cable.

17. A pre-wired circuit component as set forth in claim 14 wherein said power supply cable has a resilient cylindrical outer jacket and said second strain relieving means comprises a cylindrical split tubular sleeve received and retained in fixed complementary engagement with said housing within said power inlet opening and having a slotted sidewall defining a bore receiving said power supply cable therethrough and said ribs extend into said bore through said slotted sidewall and deformingly engage and grip said resilient outer jacket within said bore.

18. A pre-wired circuit component as set forth in claim 1 wherein said connecting means comprise bus bars.

19. A pre-wired circuit component as set forth in claim 18 wherein said component includes a dielectric bus separator disposed within said housing and separating said bus bars from each other.

20. A pre-wired circuit component as set forth in claim 1 including position indicating means for determining the selected connected position of said second connecting element relative to said first connecting element.

21. A pre-wired circuit component as set forth in claim 20 wherein said indicating means is further characterized as tactile means for determining said selected connected position.

22. A pre-wired circuit component as set forth in claim 21 wherein said tactile means comprises raised indicia of position on one of said elements including said housing element and said second connecting element and a raised pointer on the other of said elements including said housing element and said second connecting element.

23. A pre-wired circuit component for a flexible wiring system comprising; a housing defining a chamber, a plurality of power conductors contained within said chamber, an elongated flexible power supply cable for connection to a power supply source and extending into said housing through a power inlet opening defined by said housing, said power supply cable having at least three supply conductors, each of said supply conductors being connected to a respectively associated one of said power conductors within said housing, a power output selector assembly including a generally cylindrical first connecting element mounted in fixed position in a power outlet opening defined by said housing and having a first group of electrical contacts electrically connected to said power conductors within said housing, said power output selector further including a generally cylindrical second connecting element for releasable connection with said first connecting element and having a second group of electrical contacts for mating with contacts of said first group when said second connecting element is connected to said first connecting element, and an elongated flexible cord drop having a plurality of outlet conductors, each of said outlet conductors being electrically connected to a respectively associated one of the contacts of said second group, said second connecting element being electrically connectable to said first connecting element in coaxial alignment with said first connecting element and in a selected one of a plurality of possible connected positions angularly spaced apart about the axis of said first connecting element to establish electrical connection between said supply cable and said cord drop, a pair of outlet conductors of said cord drop being electrically connected to a different pair of supply connectors of said supply cable in each one of said connected positions, whereby electrical power may be delivered by said supply cable to said cord drop at a substantially different voltage at each of said connected positions.

24. A pre-wired circuit component as set forth in claim 23 including first strain relieving means for releasably securing said second connecting element to said first connecting element in each of said connected positions.

25. A pre-wired circuit component as set forth in claim 24 including second strain relieving means for engaging said power supply cable within said power inlet opening to relieve strain in said power supply cable relative to said housing.

26. A pre-wired circuit component for a flexible wiring system comprising: a housing defining a power inlet opening and a power outlet opening, an elongated flexible power supply cable for connection to a power supply source and extending into said housing through said power inlet opening, and a rotational power outlet selector assembly including a generally cylindrical first connecting element mounted in fixed position within said power outlet opening and connected to said power supply cable within said housing for receiving power from said power supply cable, said rotational power outlet selector assembly further including a cord drop assembly having a flexible cord drop and a generally cylindrical second connecting element connected to said cord drop for releasable coaxial electrical plugging connection to said first connecting element to supply power received from said power supply cable to said cord drop, said second connecting element being electrically connectable to said first connecting element in a selected one of a plurality of possible connected positions angularly spaced apart about the axis of said first connecting element, said power supply cable delivering power to said cord drop at a substantially different voltage at each of said connected positions, said cord drop assembly further including second strain relieving means for relieving strain in said power supply within and relative to said housing.

27. A pre-wired circuit component as set forth in claim 26 wherein said second strain relieving means includes a plurality of ribs integrally formed on said housing and projecting into and engaging said power supply cable within said power inlet opening.

28. A pre-wired circuit component as set forth in claim 27 wherein said power supply cable has an outer jacket characterized by helical ridge and valley convolutions and each of said ribs is disposed within a valley convolution and between associated rib convolutions.

29. A pre-wired circuit component as set forth in claim 28 wherein said power supply cable comprises a BX (metal clad) cable.

30. A pre-wired circuit component as set forth in claim 27 wherein said power supply cable has a resilient cylindrical outer jacket and said second strain relieving means comprises a cylindrical split tubular sleeve received and retained within said power inlet opening and having a slotted sidewall defining a bore receiving said power supply cable therethrough and said ribs extend into said bore through said slotted sidewall and deformingly engage and grip said resilient outer jacket within said bore.

* * * * *